US006003669A

United States Patent [19]

Baricevic

[11] Patent Number: 6,003,669

[45] Date of Patent: Dec. 21, 1999

[54] PORTABLE BAG CONTAINER

[76] Inventor: Gordan Baricevic, 655 Broadview Avenue, Apt. 1205, Toronto, Ontario, Canada, M1L 4G9

[21] Appl. No.: 08/948,798

[22] Filed: Oct. 10, 1997

[51] Int. Cl.[6] ..... B65D 33/00

[52] U.S. Cl. ..... 206/408; 206/409; 206/554

[58] Field of Search ..... 206/389, 397, 206/398, 408, 409, 554, 38, 37

[56] References Cited

U.S. PATENT DOCUMENTS

| | | | |
|---|---|---|---|
| 1,262,447 | 4/1918 | Carr . | |
| 1,657,250 | 1/1928 | Fetters . | |
| 4,358,944 | 11/1982 | Stoffel | 70/457 |
| 4,904,092 | 2/1990 | Campbell et al. | 206/554 |
| 4,955,505 | 9/1990 | Battaglia | 206/397 X |
| 5,009,516 | 4/1991 | Geeck | 383/37 |
| 5,551,569 | 9/1996 | Garvin-Mazzarisi | 206/554 |
| 5,560,321 | 10/1996 | Hess | 119/858 |
| 5,642,810 | 7/1997 | Warner et al. | 206/409 X |

*Primary Examiner*—Jacob K. Ackun
*Attorney, Agent, or Firm*—Merek & Voorhees

[57] ABSTRACT

A portable bag container to hold and dispense disposable bags. The container includes a housing that has a generally hollow interior, an axle within the housing that is capable of receiving a plurality of disposable bags wrapped thereon to form a continuous roll of disposable bags, and a hanger that enables the device to releasably secure the housing to an object. The hollow interior is capable of releasably storing a plurality of disposable bags and includes an opening to allow the disposable bags to be removed from it. The hanger includes a pair of clip members connected by a bridge portion and has a pair of inwardly extending arms for attaching the clip members to the housing. The inwardly extending arms engage the ends of the axle such that the axle revolves about the arms when a disposable bag is withdrawn through the opening in the housing.

7 Claims, 1 Drawing Sheet

PORTABLE BAG CONTAINER

FIELD OF THE INVENTION

This invention relates to a portable bag container of the type that can be used to retain a roll of disposable bags such as would typically be used as litter bags for containing and disposing of dog or animal droppings.

BACKGROUND OF THE INVENTION

Many towns, cities and municipalities have by-laws that require the owners of dogs and other animals to pick up and dispose of feces that are dropped by their animals on public property. Accordingly, animal owners who walk their animals or allow them to run freely on public property must typically carry with them devices or objects which can be used to scoop and contain animal droppings. By far the most common method of picking up after pets is for owners to carry with them plastic bags or gloves that may be used to pick up and retain the droppings until such time as they may be properly disposed of.

Unfortunately, it is commonly the case that individuals either forget to carry with them plastic bags, gloves or other devices that may be used to pick up droppings from their animals, or fail to carry with them a sufficient number of bags or devices when they are walking their animals on public streets and property. There is therefore a need for a device that can be readily carried by, or attached to, either an individual or a dog or pet within which a number of disposable bags can be carried such that the owner is never without a means to clean up after his or her animal. There is also a need for such a device having a relatively compact size and the ability to be replenished with bags as they are used up.

SUMMARY OF THE INVENTION

The invention therefore provides a portable bag container that may be readily carried by an individual or that may be attached to a garment or key chain, or that may alternatively be attached to the leash, collar or harness of a pet, and which will hold and dispense a number of disposal bags such that an individual has a constant supply of bags with which to clean up pet droppings.

Accordingly, in one of its aspects the invention provides a portable bag container to hold and dispense disposal bags, the container comprising a housing having a generally hollow interior, said hollow interior capable of releasably storing a plurality of disposable bags and including an opening therethrough to allow the disposable bags to be removed therefrom; an axle member positioned within said housing and capable of receiving a plurality of disposable bags wrapped thereon to form a continuous roll of disposable bags joined at their ends by way of perforated transitions, said axle member rotatable within said housing such that as one disposable bag is withdrawn from said interior of said housing through said opening said axle member revolves within said housing thereby unrolling a subsequent disposable bag from the roll; and, a hanger attached to said housing and providing a means to releasably secure said housing to an object, said hanger including a pair of clip members connected by a bridge portion and having a pair of inwardly extending arms for attaching said clip members to said housing, said inwardly extending arms engaging the ends of said axle member such that said axle member revolves about said arms when a disposable bag is withdrawn through said opening in said housing.

Further objects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which:

FIG. 4 1s a side view of the device in FIG. 1 with a portion shown in cross-section in order to depict its features.

DESCRIPTION OF THE PREFERRED EMBODIMENT

Figure 1:
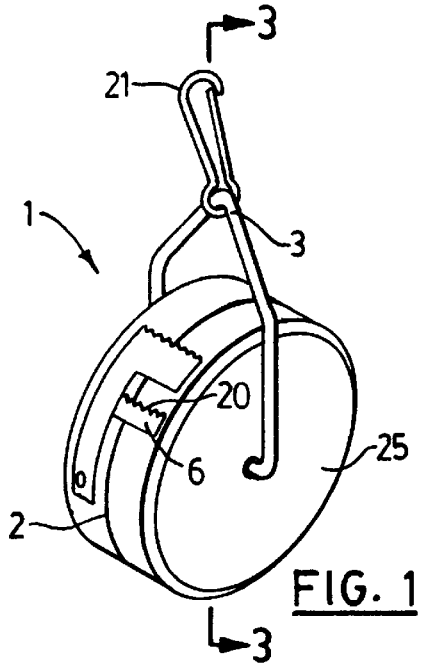
FIG. 1 is an upper side perspective view of the portable bag container of the present invention.

The invention may be embodied in a number of different forms. However, the specification and drawings that follow describe and disclose only some of the specific forms of the invention and are not intended to limit the scope of the invention as defined in the claims that follow herein.

In the attached drawings the portable bag container according to the present invention is noted generally by the reference numeral 1. Portable bag container 1 is designed to hold and dispense disposable bags and is generally comprised of a housing 2, a hanger 3 and an axle member 4. In the preferred embodiment housing 2 is a generally cylindrical hollow shell having a pair of ends 23 and 24, a side surface 25 and having axle member 4 positioned at its central axis. Housing 2 further includes an opening 6 through its exterior surface. Preferably opening 6 is located in a side surface of housing 2. Housing 2 is thus capable of receiving and storing a number of disposable bags which may be withdrawn from within hollow interior 5 through opening 6.

Figure 2:
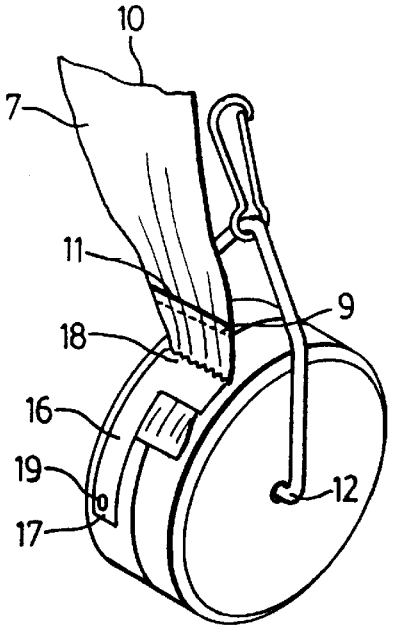
FIG. 2 is an upper side perspective view of the portable bag container of FIG. 1 having a disposal bag extending therefrom.
Figure 3:
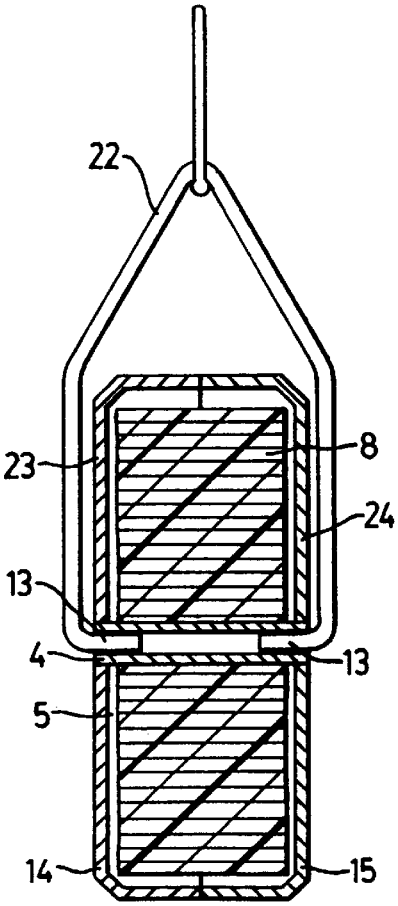
FIG. 3 is a sectional view taken along the line 3—3 of FIG. 1.
Figure 4:
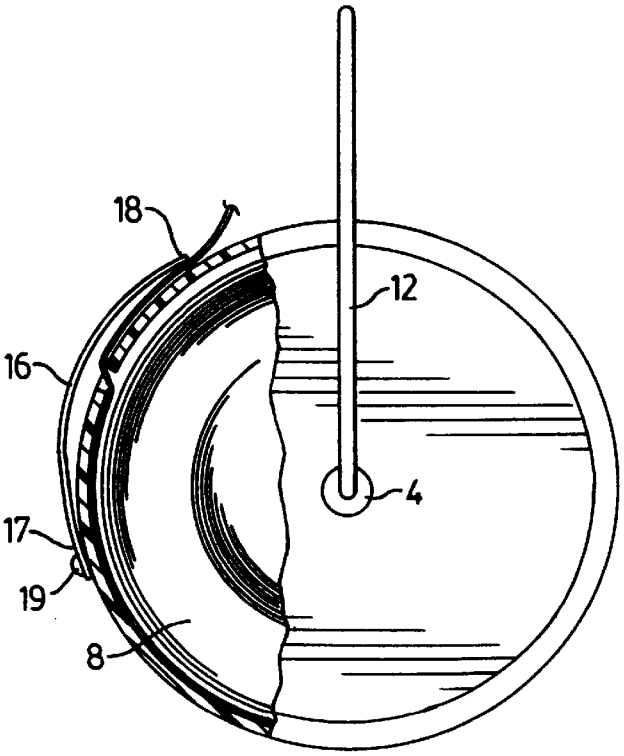

It will be appreciated that the disposable bags that may be stored within hollow interior 5 may take one of a variety of different forms. The bags are preferably made from plastic but may also be made from paper or other material and may be of a variety of different shapes and sizes. They may also be formed in the shape of a glove that can be placed over an individual's hand. It will also be appreciated that the bags may be stored within housing 2 in a number of different ways, including packing the bags randomly within hollow interior 5, folding the bags and placing them with the housing or winding them on a roll. In the preferred embodiment, and as shown in FIGS. 2 through 4, the disposable bags (generally noted by reference numeral 7) are in the form of plastic bags that are joined together end to end in a single strand and wound around axle member 4, thereby creating a continuous roll 8 of bags. Preferably each individual bag has an open upper end 10 and a sealed lower end 11. Adjacent bags on the roll are separated by a perforated transition 9 such that an individual bag may be detached from the roll by merely applying a tensile force along the perforations and effectively tearing the bag from the roll.

To enhance the portability of bag container 1, disposable bags 7 are preferably folded prior to being wound upon axle member 4. In this manner the width of roll 8 can remain relatively narrow. While it will be appreciated that different sizes of disposable bags 7 could be used for different applications, where portable bag container 1 is to be used for purposes of picking up after pets it is contemplated that the size of bag that would be utilized would be similar to a standard sandwich bag commonly used to store and retain the freshness of a sandwich. That being the case, in one embodiment of the invention, prior to rolling the bags upon axle member 4 they are folded longitudinally such that the width of roll 8 is in the range of approximately ½" to 1". Forming roll 8 in this manner will enable a reasonable number of bags to be retained within housing 2 while at the same time minimize the size of the housing in order to maintain the overall portability of the device.

In the preferred embodiment, in order to facilitate the rotation of axle member 4 within hollow interior 5, axle member 4 is comprised of a hollow tube that extends through ends 23 and 24 of housing 2. As is more particularly shown in FIG. 3, hanger 3, is comprised of a pair of clip members 12 and a bridge portion 22. Each clip member 12 includes an inwardly extending arm 13 that serves as a means to attach the clip to housing 2 through the engagement of arms 13 with the ends of axle member 4. As shown in FIG. 3, arms 13 generally comprise rod members that are releasably received within the ends of the hollow tube that comprises axle member 4. In this manner clip members 12 and bridge 22 serve as a means to both hang and secure housing 2 to another object, and also provide a mechanism to securely hold axle member 4 in position. Arms 13 further provide an axis about which axle member 4 may freely rotate. As a disposable bag is withdrawn from hollow interior 5 through opening 6, the roll of bags contained within the hollow interior is thus free to rotate, together with axle member 4, about the ends of arms 13.

So as to enhance the versatility of device 1, clip member 12 is comprised of a resilient material, such as metal or plastic, so that arms 13 may be displaced outwardly from one another to a point where they no longer engage either housing 2 or axle member 4. In this manner when the supply of disposable bags within hollow interior 5 has been exhausted clip 12 may be in effect "opened" to allow for housing 2 to be removed such that the supply of bags within it can be replenished or a new housing, having a fresh supply of bags, inserted between arms 13. To indicate that the supply of bags within hollow interior 5 is nearly exhausted the first two or three bags that are wound around axle member 4 contain markings that provide a visual indicator to an individual using portable bag container 1 that a fresh supply of bags will soon be needed. That is, as the supply of bags is gradually used up the final bags that are dispensed will contain visual markings alerting the user that there are only two or three bags left. These markings may take the form of coloured markings on the bags themselves or stickers or labels that have been applied to the bags.

In the preferred embodiment housing 2 is comprised of two shell portions 14 and 15. During manufacturing a roll of disposable bags 7 may be placed between shell portions 14 and 15 with the respective shell portions thereafter being glued or fastened together. When the supply of bags within hollow interior 5 is exhausted clip members 12 may be sprung open to release housing 2 such that it may be disposed and a new housing filled with bags inserted and replaced. Alternatively, shell portions 14 and 15 may be constructed such that their edges abut against one another and are held tightly together through the resiliency of clip members 12. When the supply of bags is exhausted clip members 12 may be "opened" such that housing 2 can be removed. The shell portions 14 and 15 may then be separated, a fresh roll of bags inserted, and the housing thereafter reassembled upon clip members 12.

Referring now specifically to FIGS. 2 and 4, portable bag container 1 further includes a retainer 16 that is secured to the exterior surface of housing 2. Retainer 16 has a lower end 17 and an upper end 18, with lower end 17 attached to housing 2 by way of a fastener 19. Fastener 19 is located at a position along side surface 25 such that the retainer extends across and spans opening 6 with upper end 18 positioned on the opposite side of opening 6 from lower end 17. It will be appreciated that retainer 16 will thus be able to help to securely hold a disposable bag 7 against the exterior of housing 2 and thereby help to prevent the end of the roll of bags from slipping backwardly through opening 6 and into hollow interior 5. To this end retainer 16 is preferably biased against the exterior surface of housing 2 such that bags that extend through opening 6 may be positioned between the exterior of side surface 25 and upper end 18 of retainer 16, with upper end 18 holding a bag tightly against the housing.

To assist in the ability of retainer 16 to securely hold bags against the surface of the housing, upper end 18 is preferably serrated. In a similar fashion, opening 6 may also contain a serrated edge 20 to help prevent bags from slipping backwardly into housing 2. In the embodiment of the invention shown in the attached drawings, retainer 16 is comprised of a resilient metal strip that is formed in an arched configuration so that upper end 18 is biased against the exterior of housing 2 when at rest. In addition, a single fastener 19 is preferably used to secure lower end 17 to housing 2. If necessary retainer 16 can then be rotated about fastener 19 to provide full and compete access to opening 6 should a bag become entangled within the opening.

To enhance the portability of device 1 and its ability to be attached to another object, hanger 3 may also include a clasp 21. Where portable bag container 1 is used to dispense bags for use by individuals walking dogs or pets, clasp 2 enables the device to be releasably secured to a dog collar or leash. Due to the relatively compact size of the device and the nature in which bags are folded and held in a tight and compact roll, portable bag container 1 will neither hinder the movement nor activities of the animal or its owner.

It is to be understood that have been described are the preferred embodiments of the invention and that it may be possible to make variations to these embodiments while staying within the broad scope of the invention. Some of these variations have been discussed while others will be readily apparent to those skilled in the art. For example, while housing 2 has been described as generally cylindrical in shape, it will be appreciated that it may equally take a variety of other shapes while staying within the scope and intent of the invention.

I claim:

1. A portable bag container to hold and dispense disposable bags, the container comprising:

a housing having a generally hollow interior, said hollow interior capable of releasably storing a plurality of disposable bags and including an opening therethrough to allow the disposable bags to be removed therefrom;

an axle member positioned within said housing and capable of receiving a plurality of disposable bags wrapped thereon to form a continuous roll of disposable bags joined at their ends by way of perforated transitions, said axle member rotatable within said housing such that as one disposable bag is withdrawn from said interior of said housing through said opening said axle member revolves within said housing thereby unrolling a subsequent disposable bag from the roll; and, a hanger attached to said housing and providing a means to releasably secure said housing to an object, said hanger including a pair of clip members connected by a bridge portion and having a pair of inwardly extending arms for attaching said clip members to said housing, said inwardly extending arms engaging the ends of said axle member such that said axle member revolves about said arms when a disposable bag is withdrawn through said opening in said housing.

2. A device as claimed in claim 1 wherein said clip members are resilient and said arms releasably attach said clip members to said housing such that when all the disposable bags are withdrawn from said housing said housing can be released from said clip members and re-filled with disposable bags or replaced with an additional housing filled with disposable bags.

3. A device as claimed in claim 2 wherein said housing includes a retainer secured to the exterior surface of said housing about said opening, said retainer biased against the exterior surface of said housing and preventing the end of the roll of disposable bags from slipping backwardly through said opening and into said housing.

4. A device as claimed in claim 3 wherein said opening and said retainer include a serrated edge to assist in the holding the end of the roll of disposable bags adjacent to the exterior surface of said housing.

5. A device as claimed in claim 4 wherein said housing is generally cylindrical in shape and said axle is positioned generally at the central axis of said housing.

6. A device as claimed in claim 5 wherein said axle is a hollow tube, said arms of said hanger comprising rod members that are receivable within the ends of said hollow tube, said hollow tube revolving about said rod members upon the withdrawal of disposable bags from said housing.

7. A device as claimed in claim 6 wherein said hanger includes a clasp to allow said portable bag container to be releasably secured to a dog collar or leash.

* * * * *